US011000748B1

(12) United States Patent
Krystosek

(10) Patent No.: US 11,000,748 B1
(45) Date of Patent: May 11, 2021

(54) PORTABLE PITCHING MOUND APPARATUS

(71) Applicant: Randy John Krystosek, Rogers, MN (US)

(72) Inventor: Randy John Krystosek, Rogers, MN (US)

( * ) Notice: Subject to any disclaimer, the term of this patent is extended or adjusted under 35 U.S.C. 154(b) by 0 days.

(21) Appl. No.: 16/245,569

(22) Filed: Jan. 11, 2019

Related U.S. Application Data

(63) Continuation-in-part of application No. 16/011,745, filed on Jun. 19, 2018, now abandoned.

(51) Int. Cl.
*A63B 71/00* (2006.01)
*A63B 69/00* (2006.01)

(52) U.S. Cl.
CPC .. *A63B 69/0002* (2013.01); *A63B 2069/0006* (2013.01); *A63B 2210/50* (2013.01)

(58) Field of Classification Search
CPC ..... A63B 69/0002; A63B 2069/0006; A63B 2210/50
USPC ..... 473/497–501, 422, 452, 168; 14/69.5
See application file for complete search history.

(56) References Cited

U.S. PATENT DOCUMENTS 3,236,520 A * 2/1966 Friedman ..... A63B 69/0002 473/452
4,666,155 A * 5/1987 Stille ..... A63B 69/0002 473/497
5,058,889 A * 10/1991 Burton ..... A63B 69/0002 473/452
5,188,357 A * 2/1993 Barnum ..... A63B 69/0002 473/497
5,467,977 A * 11/1995 Beck ..... A63B 69/0013 473/497
5,707,305 A * 1/1998 Goeders ..... A63B 69/0002 473/497
6,843,739 B2 * 1/2005 Putnam ..... A63B 69/0002 473/451
7,621,831 B2 * 11/2009 Roberts ..... A63B 69/0002 473/497
8,157,678 B2 * 4/2012 Goeders ..... A63B 69/0002 473/497
10,160,470 B2 * 12/2018 Unrath ..... B62B 3/027 280/641
2004/0090047 A1 * 5/2004 Kang ..... A63B 55/00 280/652
2009/0233740 A1 * 9/2009 Gensler ..... A63B 69/0002 473/497
2011/0021296 A1 * 1/2011 Johnston ..... A63B 69/0002 473/452
2013/0196797 A1 * 8/2013 Lee ..... A63B 71/02 473/497
2013/0345000 A1 * 12/2013 Gangwer ..... A63B 69/0002 473/497

(Continued)

*Primary Examiner* — Mitra Aryanpour
(74) *Attorney, Agent, or Firm* — Vidas Arrett & Steinkraus P.A.

(57) ABSTRACT

A portable pitching mound apparatus for providing a lightweight, easily transportable, and foldable artificial pitching mound. The portable pitching mound apparatus includes a pitching mound assembly including pitching mound members made of plastic and hingedly attached end-to-end with wheels mounted to one of the pitching mound members and with a fastening assembly for fastening the pitching mound members together with the pitching mound members folded upon one another for easy transport.

15 Claims, 4 Drawing Sheets

(56) References Cited

U.S. PATENT DOCUMENTS

2015/0310842 A1* 10/2015 Coburn ..... G10G 7/005
206/314
2016/0296822 A1* 10/2016 Semerano ..... A63B 69/0002
473/497

* cited by examiner

PORTABLE PITCHING MOUND APPARATUS

CROSS-REFERENCE TO RELATED APPLICATIONS

The present application claims priority to the non-provisional application Ser. No. 16/011,745 filed on Jul. 19, 2018, the disclosure of which is expressly incorporated by reference herein in its entirety.

BACKGROUND OF THE INVENTION

Field of the Invention

The present invention relates to pitching mounds and more particularly pertains to a new portable pitching mound apparatus for providing a lightweight, easily transportable, and foldable artificial pitching mound.

Description of the Prior Art

The use of pitching mounds is known in the prior art. More specifically, pitching mounds heretofore devised and utilized are known to consist basically of familiar, expected and obvious structural configurations, notwithstanding the myriad of designs encompassed by the crowded prior art which have been developed for the fulfillment of countless objectives and requirements.

The prior art includes an expanded plastic core with bottom of the mound being planar and preferably covered with an anti-slip material when the mound is used indoors. The mound comprises a single, unitary, one-piece, ramp-like structure having a top surface with a planar horizontal part and a planar part extending forwardly and downwardly therefrom. Another prior art includes a portable pitching mound having a height setting mechanism and a plurality of wheels for portability. The portable pitching mound is comprised of a supported base frame unit with an anti-sink device that supports a non-collapsible and non-removable single downward sloping ramp section, the surface of which is covered with artificial turf and contains a conventional pitching rubber. Also another portable pitching mound includes a generally convex body member having detachably securable front and rear portions. The rear portion has top and bottom surfaces with a peripheral edge extending therebetween. While these devices fulfill their respective, particular objectives and requirements, the aforementioned patents do not disclose a new portable pitching mound apparatus.

SUMMARY OF THE INVENTION

The general purpose of the present invention, which will be described subsequently in greater detail, is to provide a new portable pitching mound apparatus which has many of the advantages of the pitching mounds mentioned heretofore and many novel features that result in a new portable pitching mound apparatus which is not anticipated, rendered obvious, suggested, or even implied by any of the prior art pitching mounds, either alone or in any combination thereof. The present invention includes a pitching mound assembly including pitching mound members made of plastic and hingedly attached end-to-end with wheels mounted to one of the pitching mound members and with a fastening assembly for fastening the pitching mound members together with the pitching mound members folded upon one another for easy transport. None of the prior art includes the combination of the elements of the present invention.

There has thus been outlined, rather broadly, the more important features of the portable pitching mound apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new portable pitching mound apparatus which has many of the advantages of the pitching mounds mentioned heretofore and many novel features that result in a new portable pitching mound apparatus which is not anticipated, rendered obvious, suggested, or even implied by any of the prior art pitching mounds, either alone or in any combination thereof.

Still another object of the present invention is to provide a new portable pitching mound apparatus for providing a lightweight, easily transportable, and foldable artificial pitching mound.

Still yet another object of the present invention is to provide a new portable pitching mound apparatus that can be folded onto itself and latched and moved on wheels using an extendable handle.

Even still another object of the present invention is to provide a new portable pitching mound apparatus that is made of lightweight plastic so that it can be easily lifted in an out of vehicles and can be set up in seconds.

These together with other objects of the invention, along with the various features of novelty which characterize the invention, are pointed out with particularity in the claims annexed to and forming a part, of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
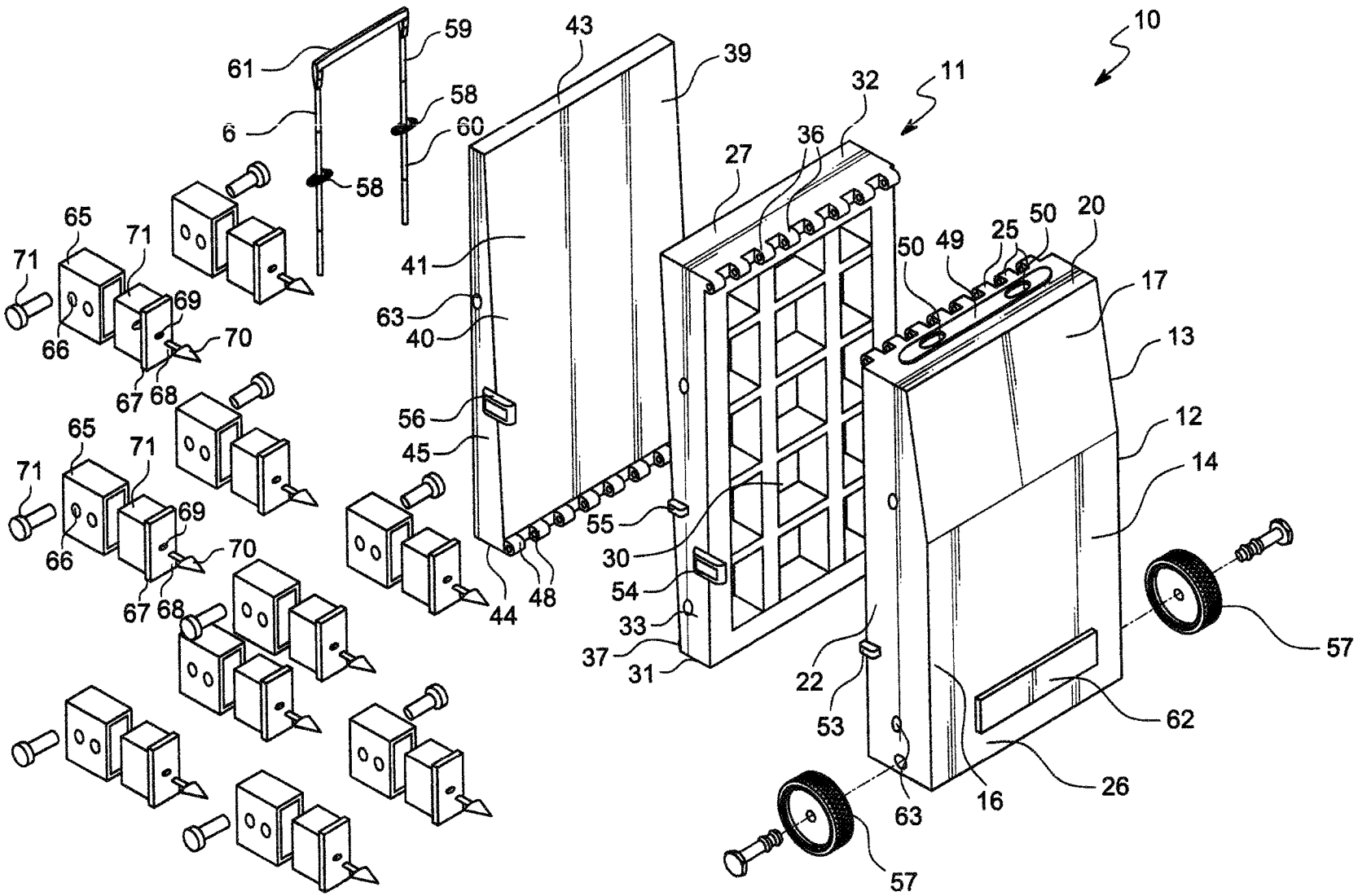
FIG. 1 is a top exploded perspective view of a new portable pitching mound apparatus according to the present invention.

With reference now to the drawings, and in particular to FIGS. 1 through 4 thereof, a new portable pitching mound apparatus embodying the principles and concepts of the present invention and generally designated by the reference numeral 10 will be described.

As best illustrated in FIGS. 1 through 4, the portable pitching mound apparatus 10 generally comprises a pitching mound assembly 11 including pitching mound members 12, 27, 39 made of plastic and hingedly attached end-to-end with wheels 57 conventionally mounted to one of the pitching mound members 12, 27, 39 and with a fastening assembly 52 for fastening the pitching mound members 12, 27, 39 together with the pitching mound members 12, 27, 39 folded upon one another for easy transport.

The pitching mound members 12, 27, 39 include a rear member 12 having a width and a length, and, also include an intermediate member 27 hingedly attached to the rear member 12 and also having a width and a length, and further include a front member 39 hingedly attached to the intermediate member 27 and having a width and a length. The rear member 12 has a top wall 13, a rear end 21, a front end 20 and sides 22 each having a bottom 19. The top wall 13 has a planar rear section 16 generally parallel with the bottoms 19 of the sides 22 and has a planar front section 17 slanted downwardly from the rear section 16 to the front end 20 with the rear end 21 having a width greater than that of the front end 20.

The intermediate member 27 has a planar top wall 28, a rear end 32, a front end 31 and sides 33. The top wall 28 is slanted downwardly from the rear end 32 to the front end 31 of the intermediate member 27 and is aligned and flush with the top wall 13 of the front section 17 when positioned end-to-end. The front member 39 has a planar top wall 40, a rear end 44, a front end 43 and sides 45. The top wall 40 is slanted downwardly from the rear end 44 to the front end 43 of the front member 40 and is aligned and flush with the top wall 40 of the intermediate member 27 when positioned end-to end.

Each of the top walls 13, 28, 40 of the pitching mound members 13, 27, 39 has a top side 14, 29, 41 and a bottom side 15, 30, 42 and has cross beams 23, 34 and longitudinal support members 24, 35 integrally attached to the bottom sides 15, 30 of the top walls 13, 28 of the rear and intermediate members 13, 27 for the strengthening thereof. The pitching mound assembly 11 includes sheets of artificial material 26, 38, 51 conventionally and securely overlaying the top walls 13, 28, 40 of the pitching mound members 13, 27, 39.

Figure 2:
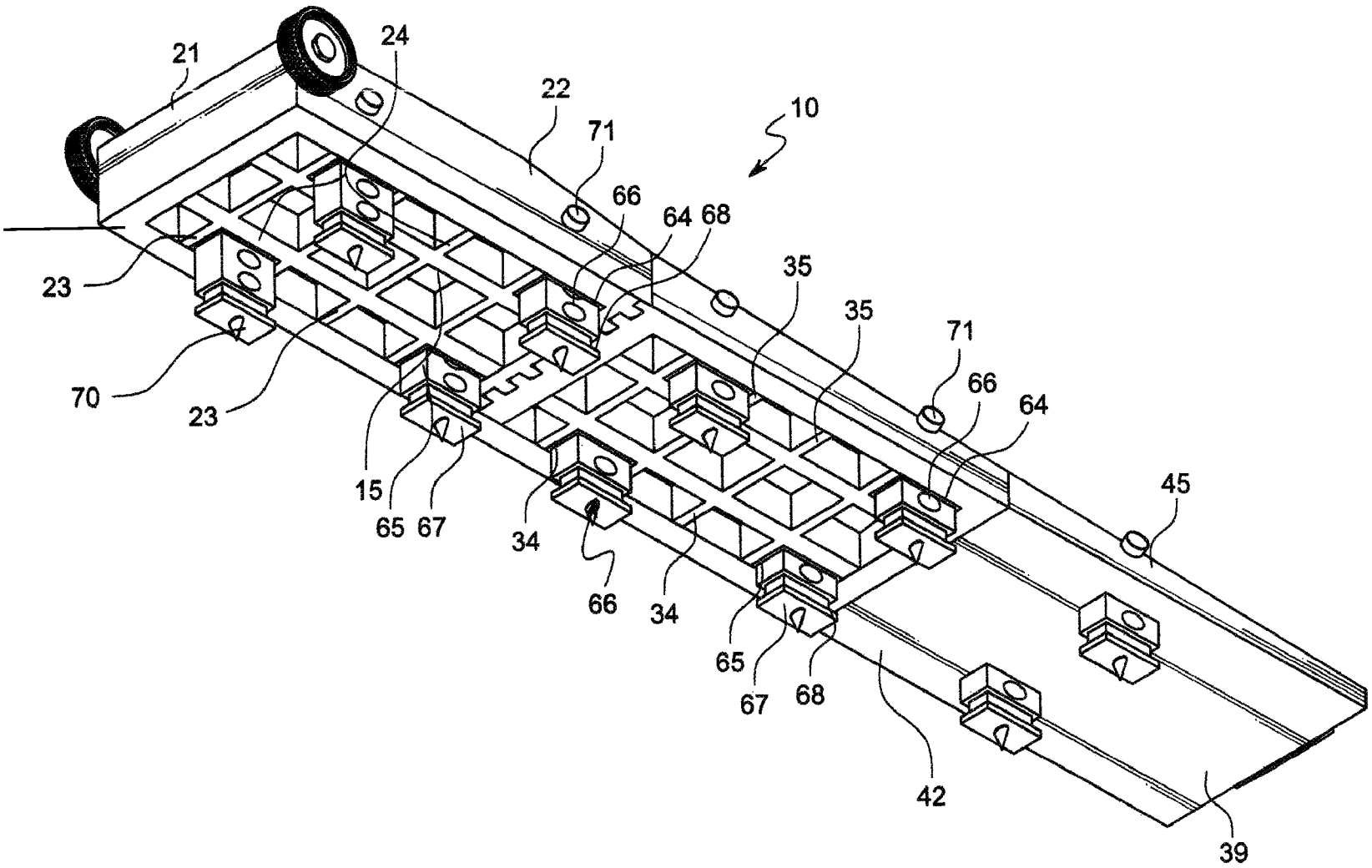
FIG. 2 is a bottom perspective view of the present invention.
Figure 3:
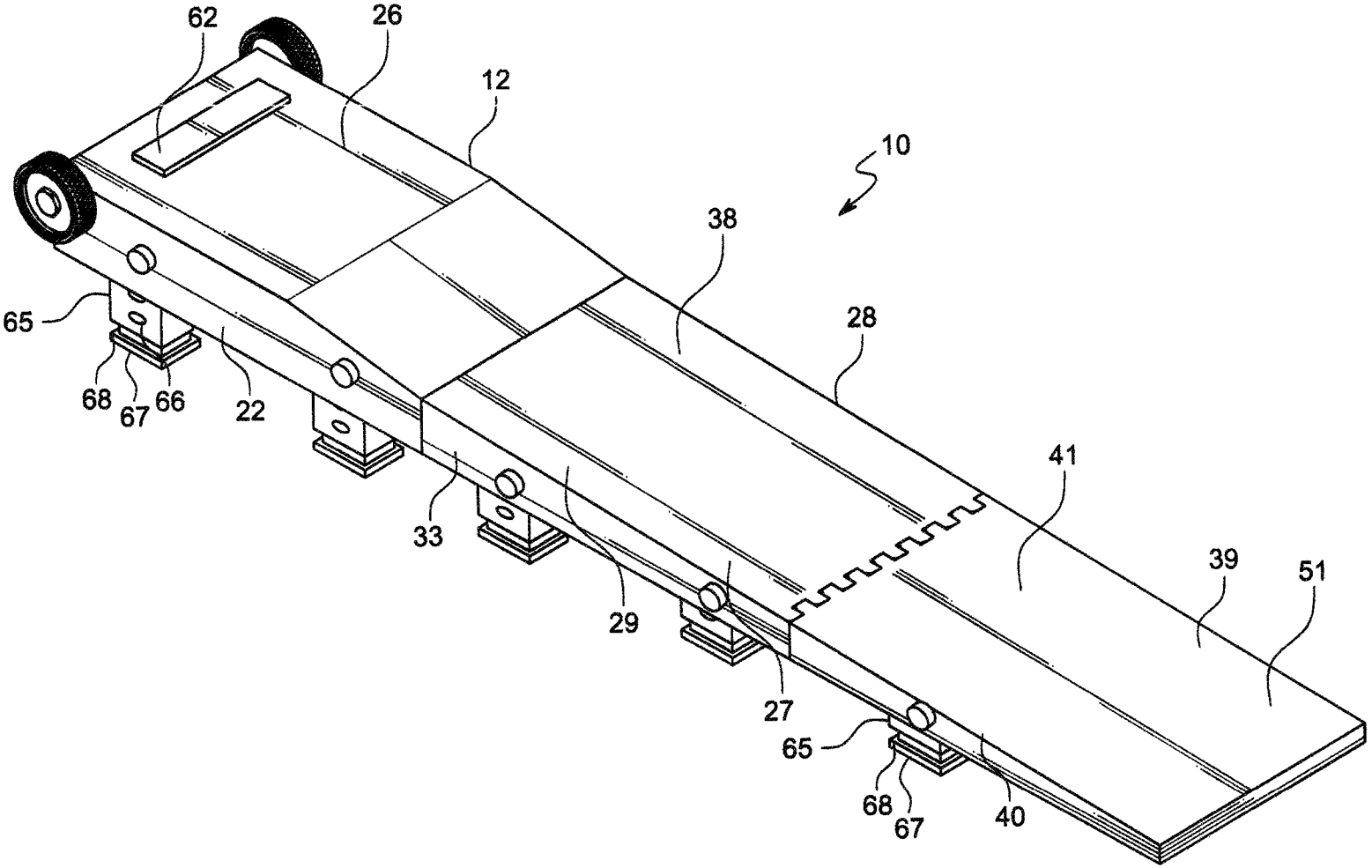
FIG. 3 is a top perspective view of the present invention.
Figure 4:
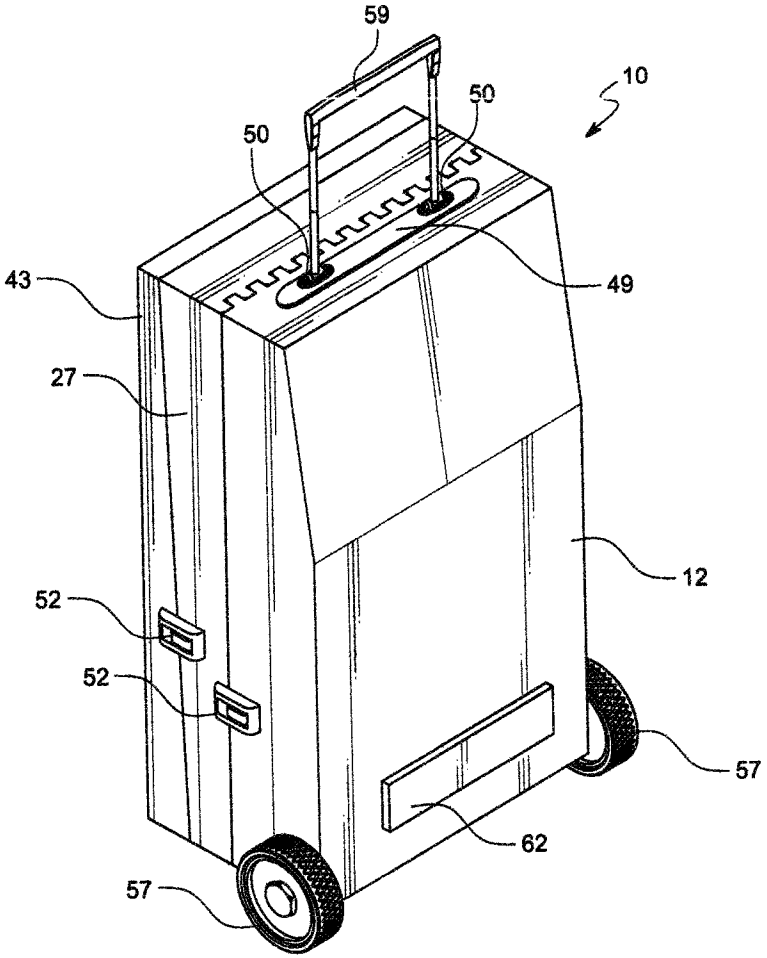
FIG. 4 is a perspective view of the present invention in a folded, latched transportable position.

As shown in FIGS. 1-3, the sides 22 33, 45 of the rear member 12, the intermediate member 27 and the front member 39 have apertures 63 disposed therethrough. The pitching mound assembly 11 includes elongated height adjustment members 65, adjustment support members 64 conventionally mounted to the sides 22, 33, 45 of the rear member 12, the intermediate member 27 and the front member 39, and securing members 71 removably disposed through the apertures 63 and being in conventional communication with the height adjustment members 65 to secure the height adjustment members 65 relative to the rear member 12, the intermediate member 27 and the front member 39 further wherein the base or bottom of the mound is coffered and the height adjustment members are received within the perimeter openings formed in the coffered base so that the height adjustment members in one of the openings formed in the base, the apertures formed in the side of the mound will be in direct communication with the apertures formed in the side of the height adjustment members and the securing member will be received in both apertures, holding the height adjustment members in the desired position. Each of the height adjustment members 65 has holes 66 disposed therethrough and has a bottom 67 with a padded member 68 conventionally attached to the bottom 67. The securing member 71 is removably disposed through the apertures 63 and through the holes 66 of the height adjustment members 65. The padded members 68 have holes 69 disposed therethrough. The pitching mound assembly 11 also includes spikes 70 removably inserted in the holes 69 of the padded members 68 and depending from the height adjustment members 65 for engaging a ground and securing the portable pitching mound apparatus 10.

The pitching mound assembly 11 also includes first endless loops 25 spaced apart and being integral to and extending outwardly from the front end 20 of the rear member 12 and extending along the width of the rear member 12 and also includes second endless loops 36 spaced apart and being integral to and extending outwardly from the rear end 32 of the intermediate member 27 and extending along a width of the intermediate member 27 and received between the first endless loops 25 with a first rod (not shown) disposed through the first and second endless loops 25, 36 to hingedly interconnect the rear and intermediate members 12, 27. The pitching mound assembly 11 also includes third endless loops 37 spaced apart and being integral to and extending outwardly from the front end 31 of the intermediate member 27 and extending along the width of the intermediate member 27 and also includes fourth endless loops 48 spaced apart and being integral to and extending outwardly from the rear end 44 of the front member 39 and extending along a width of the front member 39 and received between the third endless loops 37 with a second rod (not shown) disposed through the third and fourth endless loops: 37, 48 to hingedly interconnect the intermediate and front members 27, 39.

The fastening assembly 52 further includes a first catch 53 conventionally attached to one of the sides 22 of the rear member 12 and also includes a first latch 54 hingedly and conventionally attached to one of the sides 33 of the intermediate member 27 with the first latch 54 engagable with the first catch 53 to lock the intermediate member 27 upon the rear member 12. The fastening assembly 52 also includes a second catch 55 conventionally attached to one of the sides 33 of the intermediate member 27 and also includes a second latch 56 conventionally and hingedly attached to one of the sides 45 of the front member 39 with the second latch 56 engagable with the second catch 55 to lock the front member 39 upon the intermediate member 27.

The rear member 12 has a recessed portion 49 disposed in the front end 20 thereof and has openings 50 spaced apart and disposed through the front end 20. The pitching mound assembly 11 further includes a handle 59 disposed in the openings 50 with the handle 59 being extendable from the front end 20 and retractable into the recessed portion 49. The handle 59 includes a pair of elongated members 60 which are movably disposed in the openings 50 of the rear member 12 and also includes a cross member 61 which conventionally interconnects the elongated members 60. The pitching mound assembly 11 further includes a pair of stoppers 58 each of which is conventionally coupled about a respective elongated member 60 and disposed in a respective opening 50 in the front end 20 of the rear member 12 and is engagable with the front end 20 of the rear member 12 to prevent the handle 59 from being removed from the rear member 12. The pitching mound assembly 11 also includes an elongated pitching rubber 62 securely and conventionally attached upon the artificial material 26 and upon the rear section 16 of the rear member 12. The wheels 57 are conventionally mounted to the sides 22 proximate to the rear end 21 of the rear member 12.

In use, the user lays out the pitching mound members 12, 27, 39 end-to-end upon the ground; whereupon, ball players can learn to practice pitching upon the pitching mound members 12, 27, 39. When finished, the user simply folds the front member 39 upon the intermediate member 27 and the intermediate member 27 upon the rear member 12 and secures the first and second latches 54, 56 to the first and second catches 53, 54 and extends the handle 59 and transport the portable pitching mound apparatus 10 upon the ground as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the portable pitching mound apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable pitching mound apparatus comprising:

a pitching mound assembly including pitching mound members which are hingedly attached end-to-end with wheels mounted to one of the pitching mound members, and with a fastening assembly for fastening the pitching mound members together with the pitching mound members folded upon one another for easy transport;

wherein the pitching mound members includes a rear member having a width and a length, and also includes an intermediate member hingedly attached to the rear member and also having a width and a length, and further includes a front member hingedly attached to the intermediate member and having a width and a length;

wherein the rear member has a top wall, a rear end, a front end and sides each having a bottom;

wherein the top wall has a planar rear section and a planar front section slanted downwardly to the front end with the rear end having a width greater than that of the front end;

wherein the intermediate member has a planar top wall, a rear end, a front end and sides;

wherein the top wall is slanted downwardly from the rear end to the front end and is aligned and flush with the top wall of the front section when positioned end-to-end;

wherein the front member has a planar top wall, a rear end, a front end and sides;

wherein the top wall is slanted downwardly from the rear end to the front end and is aligned and flush with the top wall of the intermediate member when positioned end-to-end, and wherein the sides of the rear member, the intermediate member and the front member have apertures disposed therethrough, wherein the pitching mound assembly includes elongated height adjustment members, adjustment support members mounted to the sides of the rear member, the intermediate member and the front member, and securing members removably disposed through the apertures and being in communication with the height adjustment members to secure the height adjustment members relative to the rear member, the intermediate member and the front member, further wherein the base or bottom of the mound is coffered and the height adjustment members are received within the perimeter openings formed in the coffered base so that the height adjustment members in one of the openings formed in the base, the apertures formed in the side of the mound will be in direct communication with the apertures formed in the side of the height adjustment members and the securing member will be received in both apertures, holding the height adjustment members in the desired position.

2. The portable pitching mound apparatus as described in claim 1, wherein each of the top walls of the pitching mound members has a top side and a bottom side, wherein the pitching mound assembly has cross beams and longitudinal support members attached to the bottom sides of the top walls of the rear and intermediate members to strengthen the pitching mound members.

3. The portable pitching mound apparatus as described in claim 1, wherein each of the height adjustment members has holes disposed therethrough and has a bottom end with a padded member attached to the bottom end, wherein the securing member is removably disposed through the apertures and through the holes of the height adjustment members.

4. The portable pitching mound apparatus as described in claim 3, wherein the padded members have holes disposed therethrough, wherein the pitching mound assembly also includes spikes removably inserted in the holes of the padded members and depending from the height adjustment members for engaging a ground and securing the portable pitching mound apparatus.

5. The portable pitching mound apparatus as described in claim 1, wherein the pitching mound assembly includes sheets of artificial material securely overlaying the top walls of the pitching mound members.

6. The portable pitching mound apparatus as described in claim 1, wherein the pitching mound assembly includes first endless loops spaced apart and being integral to and extending outwardly from the front end of the rear member and extending along the width of the rear member and also includes second endless loops spaced apart and being integral to and extending outwardly from the rear end of the intermediate member and extending along a width of the intermediate member and received between and interconnected to the first endless loops to hingedly interconnect the rear and intermediate members.

7. The portable pitching mound apparatus as described in claim 1, wherein the pitching mound assembly also includes third endless loops spaced apart and being integral to and extending outwardly from the front end of the intermediate member and extending along the width of the intermediate member and also includes fourth endless loops spaced apart and being integral to and extending outwardly from the rear end of the front member and extending along a width of the intermediate member and received between and interconnected to the third endless loops to hingedly interconnect the intermediate and front members.

8. The portable pitching mound apparatus as described in claim 1, wherein the fastening assembly further includes a first catch attached to one of the sides of the rear member and also includes a first latch hingedly attached to one of the sides of the intermediate member with the first latch engagable with the first catch to lock the intermediate member upon the rear member.

9. The portable pitching mound apparatus as described in claim 8, wherein the fastening assembly also includes a second catch attached to one of the sides of the intermediate member and also includes a second latch hingedly attached to one of the sides of the front member with the second latch engagable with the second catch to lock the front member upon the intermediate member.

10. The portable pitching mound apparatus as described in claim 1, wherein the rear member has a recessed portion disposed in the front end thereof and has openings spaced apart and disposed through the front end.

11. The portable pitching mound apparatus as described in claim 10, wherein the pitching mound assembly further includes a handle disposed in the openings with the handle being extendable from the front end and retractable into the recessed portion.

12. The portable pitching mound apparatus as described in claim 11, wherein the handle includes a pair of elongated members which are movably disposed in the openings of the front member and also includes a cross member which interconnects the elongated members.

13. The portable pitching mound apparatus as described in claim 12, wherein the handle further includes a pair of stoppers each of which is coupled about a respective said elongated member and disposed in a respective opening in the front end of the rear member and is engagable with the front end of the rear member to prevent the handle from being removed from the rear member.

14. The portable pitching mound apparatus as described in claim 5, wherein the pitching mound assembly also includes an elongated pitching rubber securely attached upon the artificial material and upon the rear section of the rear member.

15. The portable pitching mound apparatus as described in claim 1, wherein the wheels are mounted to the sides proximate to the rear end of the rear member.

* * * * *